US005199076A

United States Patent [19]

Taniguchi et al.

[11] Patent Number: 5,199,076

[45] Date of Patent: Mar. 30, 1993

[54] SPEECH CODING AND DECODING SYSTEM

[75] Inventors: Tomohiko Taniguchi, Kawasaki, Japan; Mark A. Johnson, Cambridge, Mass.; Hideaki Kurihara, Kawasaki, Japan; Yoshinori Tanaka, Kawasaki, Japan; Yasuji Ohta, Kawasaki, Japan

[73] Assignee: Fujitsu Limited, Japan

[21] Appl. No.: 761,048

[22] Filed: Sep. 18, 1991

[30] Foreign Application Priority Data

Sep. 18, 1990 [JP] Japan ..... 2-248484

[51] Int. Cl.[5] ..... G10L 5/00

[52] U.S. Cl. ..... 381/36; 381/49

[58] Field of Search ..... 381/30–37, 381/49

[56] References Cited

U.S. PATENT DOCUMENTS

| | | | |
|---|---|---|---|
| 4,860,355 | 8/1989 | Copperi | 381/36 |
| 4,868,867 | 9/1989 | Davidson et al. | 381/36 |
| 4,991,214 | 2/1991 | Freeman et al. | 381/38 |
| 5,027,405 | 6/1991 | Ozawa | 381/35 |
| 5,091,946 | 2/1992 | Ozawa | 381/36 |

OTHER PUBLICATIONS

W. B. Kleijn Fast Methods for the CELP Speech Coding Algorithm, pp. 1330–1342 IEEE Trans. ASSP, vol. 38, No. 8 (Aug. 1990).

*Primary Examiner*—Emanuel S. Kemeny
*Attorney, Agent, or Firm*—Staas & Halsey

[57] ABSTRACT

A CELP type speech coding system is provided with an arithmetic processing unit which transforms a perceptual weighted input speech signal vector AX to a vector $^t$AAX, a sparse adaptive codebook which stores a plurality of pitch prediction residual vectors P sparsed by a sparse unit, and a multiplying unit which multiplies the successively read out vectors P and the output $^t$AAX from the arithmetic processing unit. In addition, the CELP type speech coding system includes a filter operation unit which performs a filter operation on the vectors P, and an evaluation unit which finds the optimum vector P based on the output from the filter operation unit, so as to enable reduction of the amount of arithmetic operations.

11 Claims, 12 Drawing Sheets

Fig. 8A $$ {}^{t}A = \begin{pmatrix} a_1 & a_2 & \cdots & a_N \\ 0 & a_1 & \cdots & a_{N-1} \\ \cdots & & \cdots & \cdots \\ 0 & 0 & \cdots & a_1 \end{pmatrix} $$

Fig. 8B $$ AX = \begin{pmatrix} X_1 \\ X_2 \\ \vdots \\ X_N \end{pmatrix} $$

Fig. 8C $$ {}^{t}AAX = \begin{pmatrix} a_1 * X_1 + a_2 * X_2 + \cdots + a_N * X_N \\ a_1 * X_2 + \cdots + a_{N-1} * X_N \\ \cdots \quad \cdots \\ a_1 * X_N \end{pmatrix} $$

Fig. 9A $$AX \begin{bmatrix} x_1 \\ x_2 \\ \vdots \\ x_N \end{bmatrix}$$

Fig. 9B $$(AX)_{TR} = \begin{bmatrix} x_N \\ \vdots \\ x_2 \\ x_1 \end{bmatrix}$$

Fig. 9C $$A\,(AX)_{TR} = \begin{bmatrix} d_N \\ \vdots \\ d_2 \\ d_1 \end{bmatrix}$$

Fig. 9D $$W = \begin{bmatrix} d_1 \\ d_2 \\ \vdots \\ d_N \end{bmatrix} = {}^{t}AAX$$

SPEECH CODING AND DECODING SYSTEM

BACKGROUND OF THE INVENTION

1. Field of the Invention

The present invention relates to a speech coding and decoding system, and more particularly to a high quality speech coding and decoding system which performs compression of speech information signals using a vector quantization technique.

In recent years, in, for example, an intracompany communication system and a digital mobile radio communication system, a vector quantization method for compressing speech information signals while maintaining a speech quality is usually employed. In the vector quantization method, first a reproduced signal is obtained by applying prediction weighting to each signal vector in a codebook, and then an error power between the reproduced signal and an input speech signal is evaluated to determine a number, i.e., index, of the signal vector which provides a minimum error power. A more advanced vector quantization method is now strongly demanded, however, to realize a higher compression of the speech information.

2. Description of the Related Art

A typical well known high quality speech coding method is a code-excited linear prediction (CELP) coding method which uses the aforesaid vector quantization. One conventional CELP coding is known as a sequential optimization CELP coding and the other conventional CELP coding is known as a simultaneous optimization CELP coding. These two typical CELP codings will be explained in detail hereinafter.

As will be explained in more detail later, in the above two typical CELP coding methods, an operation is performed to retrieve (select) the pitch information closest to the currently input speech signal from among the plurality of pitch information stored in the adaptive codebook.

In such pitch retrieval from an adaptive codebook, a convolution is calculated of the impulse response of the perceptual weighting reproducing filter and the pitch prediction residual signal vectors of the adaptive codebook, so if the dimensions of the M number ($M=128$ to 256) of pitch prediction residual signal vectors of the adaptive codebook is N (usually $N=40$ to 60) and the order of the perceptual weighting filter is $N_P$ (in the case of an IIR type filter, $N_P=10$), then the amount of arithmetic operations of the multiplying unit becomes the sum of the amount of arithmetic operations $N \times N_P$ required for the perceptual weighting filter for the vectors and the amount of arithmetic operations N required for the calculation of the inner product of the vectors.

To determine the optimum pitch vector P, this amount of arithmetic operations is necessary for all of the M number of pitch vectors included in the codebook and therefore there was the problem of a massive amount of arithmetic operations.

SUMMARY OF THE INVENTION

Therefore, the present invention, in view of the above problem, has as its object the performance of long term prediction by pitch period retrieval by this adaptive codebook and the maximum reduction of the amount of arithmetic operations of the pitch period retrieval in a CELP type speech coding and decoding system.

To attain the above object, the present invention constitutes or includes the adaptive codebook by a sparse adaptive codebook which stores the sparse pitch prediction residual signal vectors P, inputs into the multiplying unit the input speech signal vector comprised of the input speech signal vector subjected to time-reverse perceptual weighting and thereby, as mentioned earlier, eliminates the perceptual weighting filter operation for each vector, and slashes the amount of arithmetic operations required for determining the optimum pitch vector.

BRIEF DESCRIPTION OF THE DRAWINGS

The above object and features of the present invention will be more apparent from the following description of the preferred embodiments with reference to the accompanying drawings, wherein:

FIGS. 8A and 8B and FIG. 8C are views showing the specific process of the arithmetic processing unit 31 of FIG. 6;

FIGS. 9A, 9B, 9C and FIG. 9D are views showing the specific process of the arithmetic processing unit 31 of FIG. 7;

DESCRIPTION OF THE PREFERRED EMBODIMENTS

Before describing the embodiments of the present invention, the related art and the problems therein will be first described with reference to the related figures.

Figure 1:
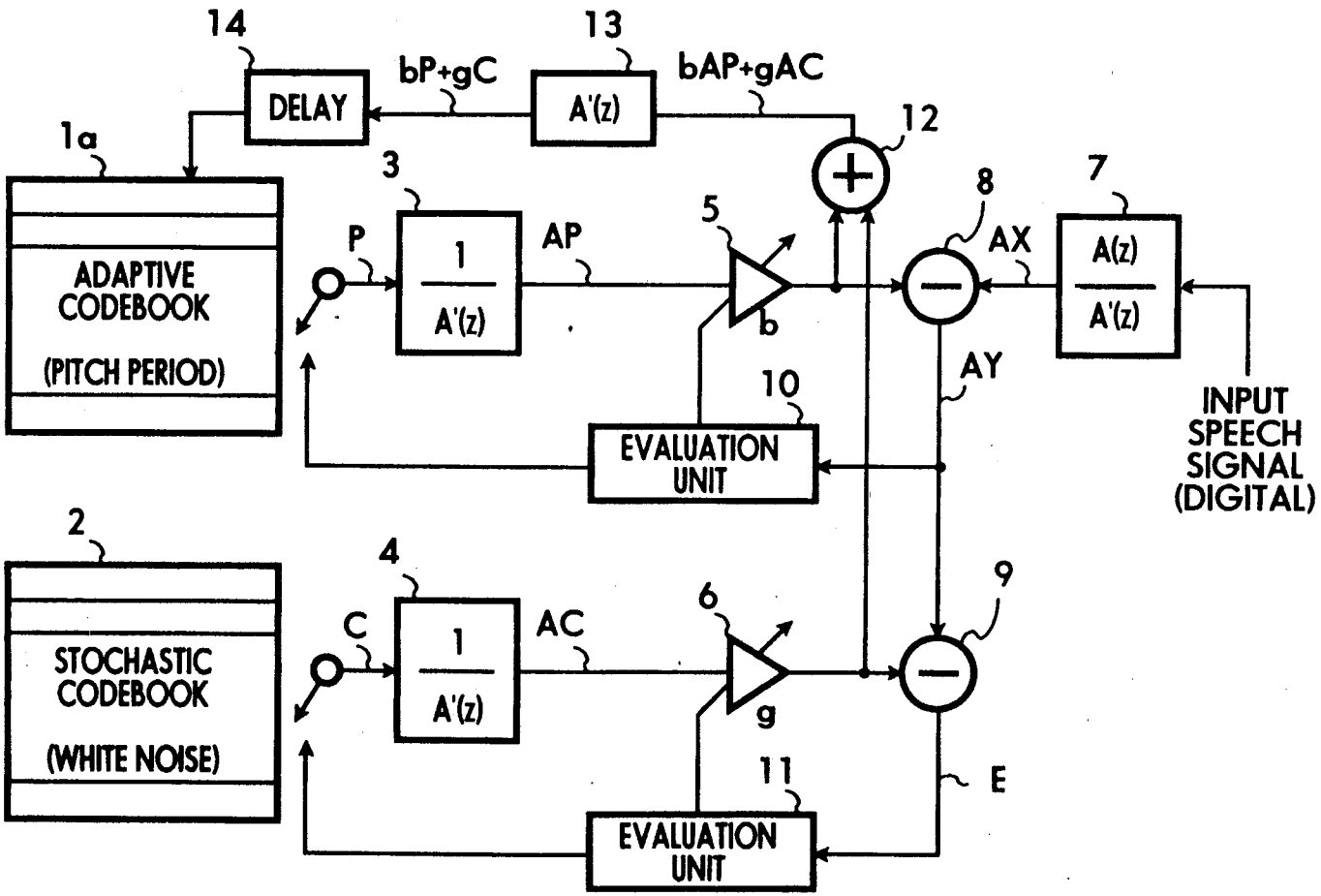
Fig. 1 PRIOR ART
FIG. 1 is a block diagram showing a general coder used for the sequential optimization CELP coding method.

FIG. 1 is a block diagram showing a general coder used for the sequential optimization CELP coding method.

In FIG. 1, an adaptive codebook la houses N dimensional pitch prediction residual signals corresponding to the N samples delayed by one pitch period per sample. A stochastic codebook 2 has preset in it $2^M$ patterns of code vectors produced using N-dimensional white noise corresponding to the N samples in a similar fashion.

First, the pitch prediction residual vectors P of the adaptive codebook la are perceptually weighted by a perceptual weighting linear prediction reproducing filter 3 shown by 1/A'(z) (where A'(z) shows a perceptual weighting linear prediction synthesis filter) and the resultant pitch prediction vector AP is multiplied by a gain b by an amplifier 5 so as to produce the pitch prediction reproduction signal vector bAP.

Next, the perceptually weighted pitch prediction error signal vector AY between the pitch prediction reproduction signal vector bAP and the input speech signal vector perceptually weighted by the perceptual weighting filter 7 shown by A(z)/A'(z) (where A(z) shows a linear prediction synthesis filter) is found or determined by a subtracting unit 8. An evaluation unit 10 selects the optimum pitch prediction residual vector P from the codebook 1*a* by the following equation (1) for each frame:

$$\begin{aligned} P &= \text{argmin}\,(|AY|^2) \\ &= \text{argmin}\,(|AX - bAP|^2) \end{aligned} \tag{1}$$

(where, argmin: minimum argument)
and selects the optimum gain b so that the power of the pitch prediction error signal vector AY becomes a minimum value.

Further, the code vector signals C of the stochastic codebook 2 of white noise are similarly perceptually weighted by the linear prediction reproducing filter 4 and the resultant code vector AC after perceptual weighting reproduction is multiplied by the gain g by an amplifier 6 so as to produce the linear prediction reproduction signal vector gAC.

Next, the error signal vector E between the linear prediction reproduction signal vector gAC and the above-mentioned pitch prediction error signal vector AY is found by a subtracting unit 9 and an evaluation unit 11 selects the optimum code vector C from the codebook 2 for each frame and selects the optimum gain g so that the power of the error signal vector E becomes the minimum value by the following equation (2):

$$\begin{aligned} C &= \text{argmin}\,(|E|^2) \\ &= \text{argmin}\,(|AY - gAC|^2) \end{aligned} \tag{2}$$

Further, the adaptation (renewal) of the adaptive codebook 1*a* is performed by finding the optimum excited sound source signal bAP+gAC by an adding unit 12, restoring this to bP+gC by the perceptual weighting linear prediction synthesis filter (A'(z)) 13, then delaying this by one frame by a delay unit 14, and storing this as the adaptive codebook (pitch prediction codebook) of the next frame.

Figure 2:
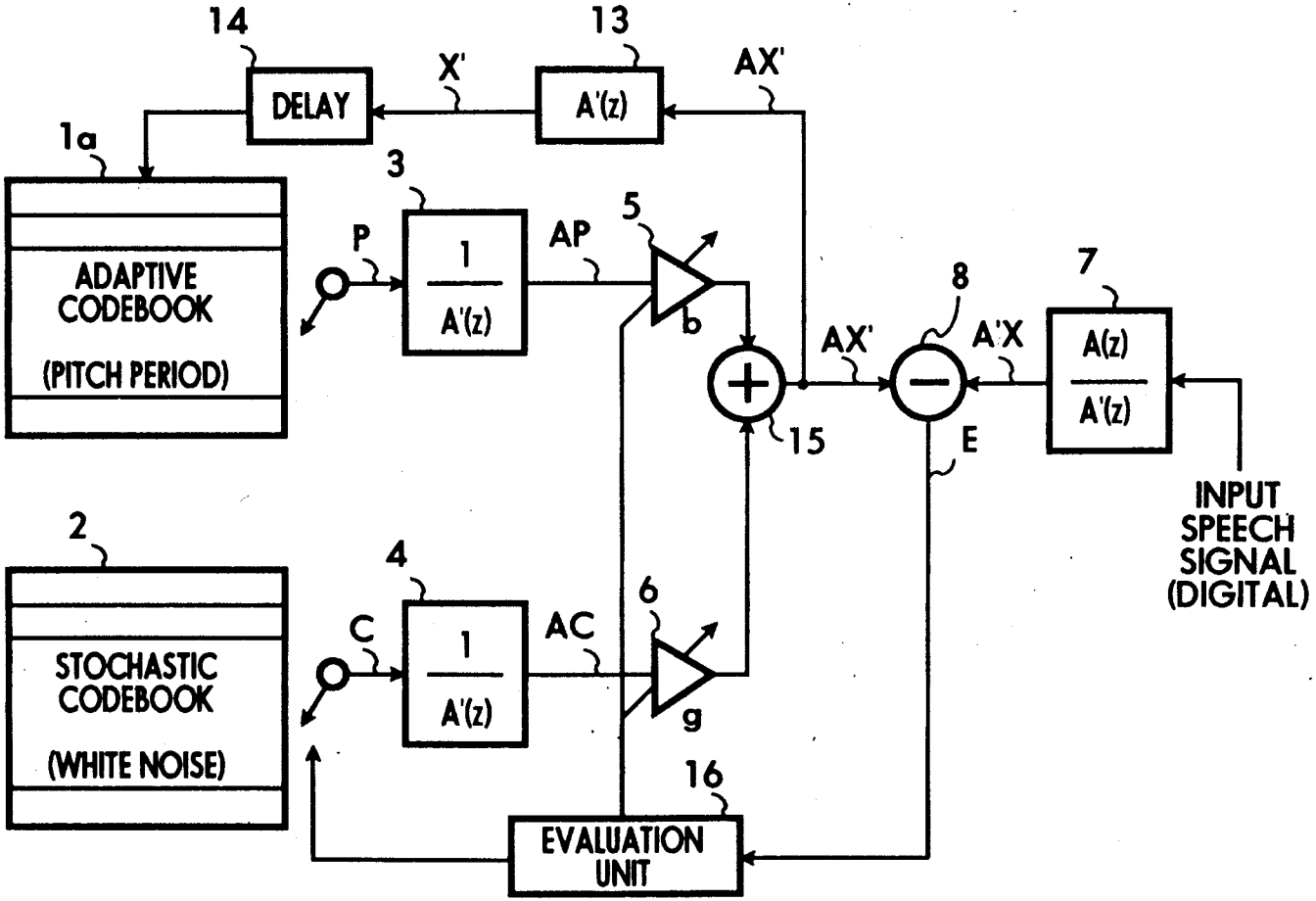
Fig. 2 PRIOR ART
FIG. 2 is a block diagram showing a general coder used for the simultaneous optimization CELP coding method.

FIG. 2 is a block diagram showing a general coder used for the simultaneous optimization CELP coding method. As mentioned above, in the sequential optimization CELP coding method shown in FIG. 1, the gain b and the gain g are separately controlled, while in the simultaneous optimization CELP coding method shown in FIG. 2, bAP and gAC are added by an adding unit 15 to find AX'=bAP+gAC and further the error signal vector E with respect to the perceptually weighted input speech signal vector AX from the subtracting unit 8 is found in the same way by equation (2). An evaluation unit 16 selects the code vector C giving the minimum power of the vector E from the stochastic codebook 2 and simultaneously exercises control to select the optimum gain b and gain g.

In this case, from the above-mentioned equations (1) and (2), $$\begin{aligned} C &= \text{argmin}\,(|E|^2) \\ &= \text{argmin}\,(|AX - bAP - gAC|^2) \end{aligned} \tag{3}$$

Further, the adaptation of the adaptive codebook 1*a* in this case is similarly performed with respect to the AX' corresponding to the output of the adding unit 12 of FIG. 1. The filters 3 and 4 may be provided in common after the adding unit 15. At this time, the inverse filter 13 becomes unnecessary.

However, actual codebook retrievals are performed in two stages: retrieval with respect to the adaptive codebook la and retrieval with respect to the stochastic codebook 2. The pitch retrieval of the adaptive codebook la is performed as shown by equation (1) even in the case of the above equation (3).

That is, in the above-mentioned equation (1), if the gain g for minimizing the power of the vector E is found by partial differentiation, then from the following:

$$\begin{aligned} 0 &= \delta(|AX - bAP|^2)/\delta b \\ &= 2^t(-bAP)(AX - bAP) \end{aligned}$$

the following is obtained:

$$b = {}^t(AP)AX/{}^t(AP)AP \tag{4}$$

(where t means a transpose operation).

Figure 3:
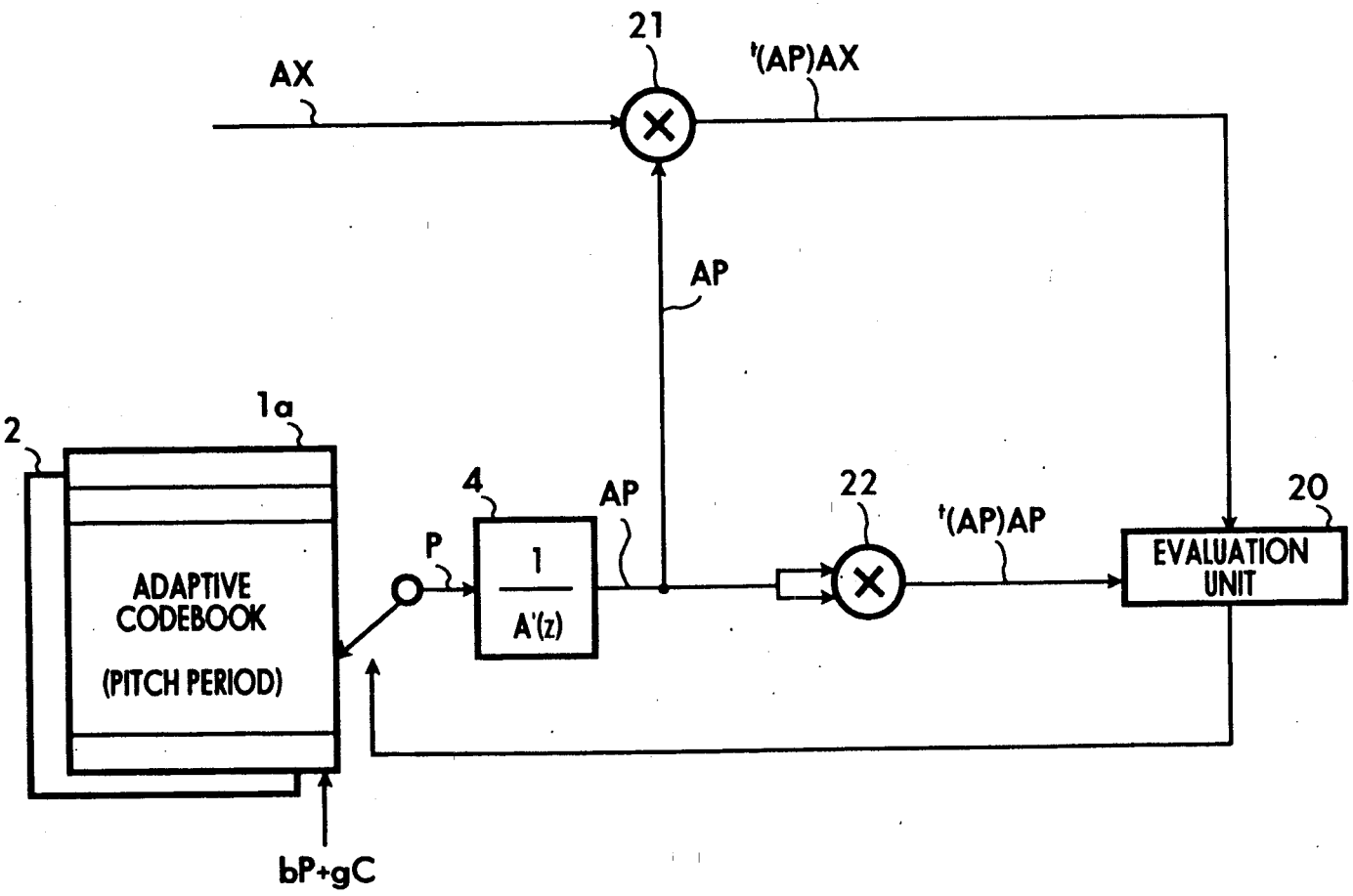
Fig. 3 PRIOR ART
FIG. 3 is a block diagram showing a general optimization algorithm for retrieving the optimum pitch period.

FIG. 3 is a block diagram showing a general optimization algorithm for retrieving the optimum pitch period. It shows conceptually the optimization algorithm based on the above equations (1) to (4).

In the optimization algorithm of the pitch period shown in FIG. 3, the perceptually weighted input speech signal vector AX and the code vector AP obtained by passing the pitch prediction residual vectors P of the adaptive codebook 1*a* through the perceptual weighting linear prediction reproducing filter 4 are multiplied by a multiplying unit 21 to produce a correlation value ${}^t$(AP)AX of the two. An autocorrelation value ${}^t$(AP)AP of the pitch prediction residual vector AP after perceptual weighting reproduction is found by a multiplying unit 22.

Further, an evaluation unit 20 selects the optimum pitch prediction residual signal vector P and gain b for minimizing the power of the error signal vector E =AY with respect to the perceptually weighted input signal vector AX by the above-mentioned equation (4) based on the correlations ${}^t$(AP)AX and ${}^t$(AP)AP.

Also, the gain b with respect to the pitch prediction residual signal vectors P is found so as to minimize the above equation (1), and if the optimization is performed on the gain by an open loop, which becomes equivalent to maximizing the ratio of the correlations:

$$({}^t(\text{AP})\text{AX})^2/{}^t(\text{AP})\text{AP}$$

That is, $$
\begin{aligned}
|E|^2 &= {}^tEE \\
&= {}^t(AX - bAP)(AX - bAP) \\
&= {}^t(AX)(AX) - 2b\,{}^t(AP)(AX) + b^2\,{}^t(AP)(AP)
\end{aligned}
$$

$$b = {}^t(AP)(AX)/{}^t(AP)(AP)$$

so $$
\begin{aligned}
|E|^2 &= {}^t(AX)(AX) - \\
&\quad 2\{{}^t(AP)(AX)\}^2/{}^t(AP)(AP) + \\
&\quad \{{}^t(AP)(AX)\}^2/{}^t(AP)(AP) \\
&= {}^t(AX)(AX) - \\
&\quad \{{}^t(AP)(AX)\}^2/{}^t(AP)(AP)
\end{aligned}
$$

If the second term on the right side is maximized, the power E becomes the minimum value.

As mentioned earlier, in the pitch retrieval of the adaptive codebook 1*a*, a convolution is calculated of the impulse response of the perceptual weighting reproducing filter and the pitch prediction residual signal vectors P of the adaptive codebook 1*a*, so if the dimensions of the M number (M=128 to 256) of pitch prediction residual signal vectors of the adaptive codebook 1*a* is N (usually N=40 to 60) and the order of the perceptual weighting filter 4 is $N_P$ (in the case of an IIR type filter, $N_P$=10), then the amount of arithmetic operations of the multiplying unit 21 becomes the sum of the amount of arithmetic operations $N \times N_P$ required for the perceptual weighting filter 4 for the vectors and the amount of arithmetic operations N required for the calculation of the inner product of the vectors.

To determine the optimum pitch vector P, this amount of arithmetic operations is necessary for all of the M number of pitch vectors included in the codebook 1*a* and therefore there was the previously mentioned problem of a massive amount of arithmetic operations.

Below, an explanation will be made of the system of the present invention for resolving this problem.

Figure 4:
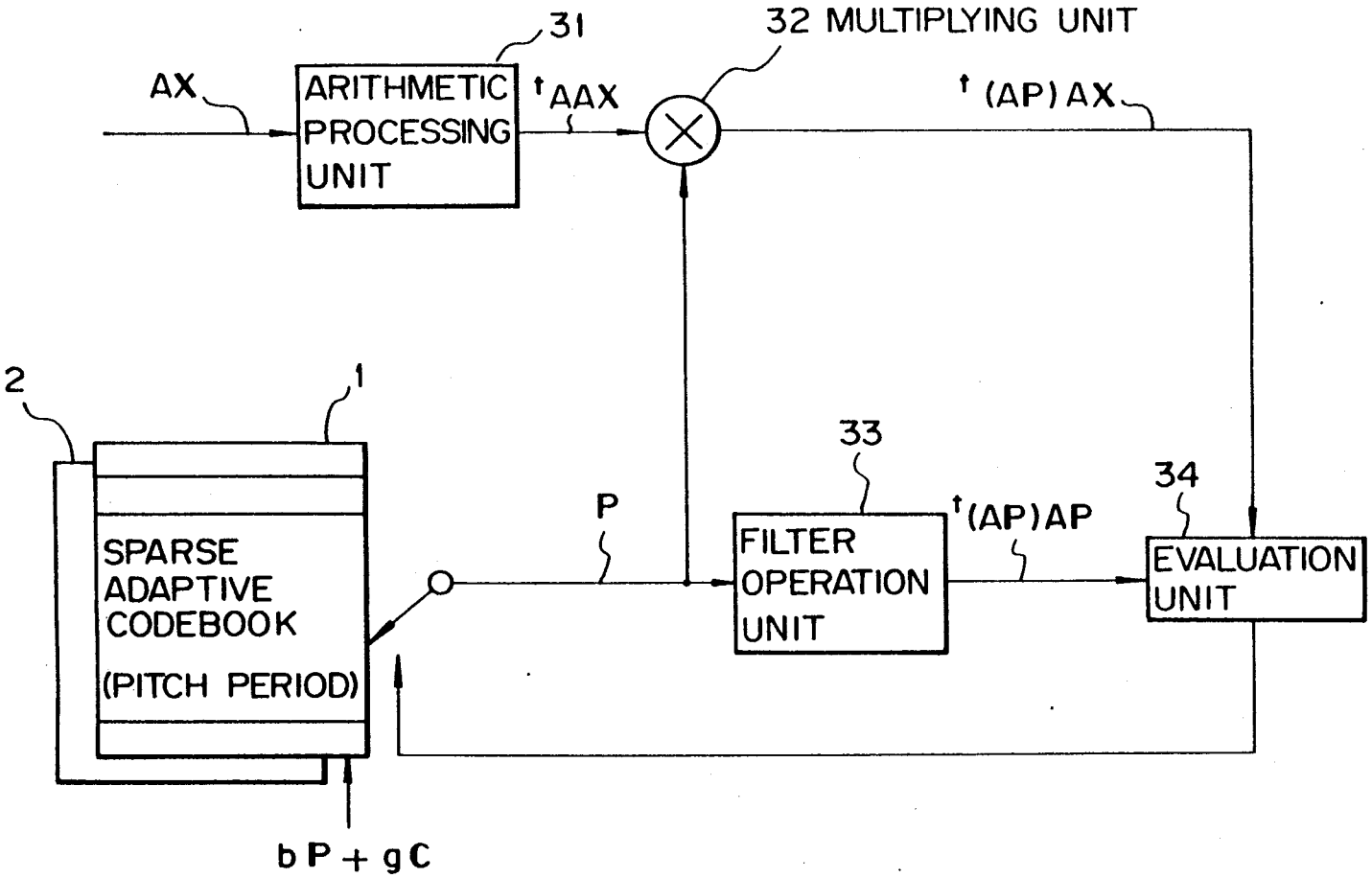
FIG. 4 is a block diagram showing the basic structure of the coder side in the system of the present invention.

FIG. 4 is a block diagram showing the basic structure of the coder side in the system of the present invention and corresponds to the above-mentioned FIG. 3. Note that throughout the figures, similar constituent elements are given the same reference numerals or symbols. That is, FIG. 4 shows conceptually the optimization algorithm for selecting the optimum pitch vector P of the adaptive codebook and gain b in the speech coding system of the present invention for solving the above problem. In the figure, first, the adaptive codebook 1*a* shown in FIG. 3 is constituted as a sparse adaptive codebook 1 which stores a plurality of sparse pitch prediction residual vectors (P). The system comprises a first means 31 (arithmetic processing unit) which arithmetically processes a time reversing perceptual weighted input speech signal ${}^tAAX$ from the perceptually weighted input speech signal vector AX; a second means 32 (multiplying unit) which receives at a first input the time reversing perceptual weighted input speech signal output from the first means, receives at its second input the pitch prediction residual vectors P successively output from the sparse adaptive codebook 1, and multiplies the two input values so as to produce a correlation value ${}^t(AP)AX$ of the same; a third means 33 (filter operation unit) which receives as input the pitch prediction residual vectors and finds or determines the autocorrelation value ${}^t(AP)AP$ of the vector AP after perceptual weighting reproduction; and a fourth means 34 (evaluation unit) which receives as input the correlation values from the second means 32 and third means 33, evaluates or determines the optimum pitch prediction residual vector and optimum code vector, and decides on the same.

In the CELP type speech coding system of the present invention shown in FIG. 4, the adaptive codebook 1 are updated by the sparse optimum excited sound source signal, so is always in a sparse (thinned) state where the stored pitch prediction residual signal vectors are zero with the exception of predetermined samples.

The one autocorrelation value ${}^t(AP)AP$ to be given to the evaluation unit 34 is arithmetically processed in the same way as in the prior art shown in FIG. 3, but the correlation value ${}^t(AP)AX$ is obtained by transforming the perceptual weighted input speech signal vector AX into ${}^tAAX$ by the arithmetic processing unit 31 and giving the pitch prediction residual signal vector P of the adaptive codebook 2 of the sparse construction as is to the multiplying unit 32, so the multiplication can be performed in a form taking advantage of the sparseness of the adaptive codebook 1 as it is (that is, in a form where no multiplication is performed on portions where the sample value is "0") and the amount of arithmetic operations can be slashed.

This can be applied in exactly the same way for both the case of the sequential optimization method and the simultaneous optimization CELP method. Further, it may be applied to a pitch orthogonal optimization CELP method combining the two.

Figure 5:
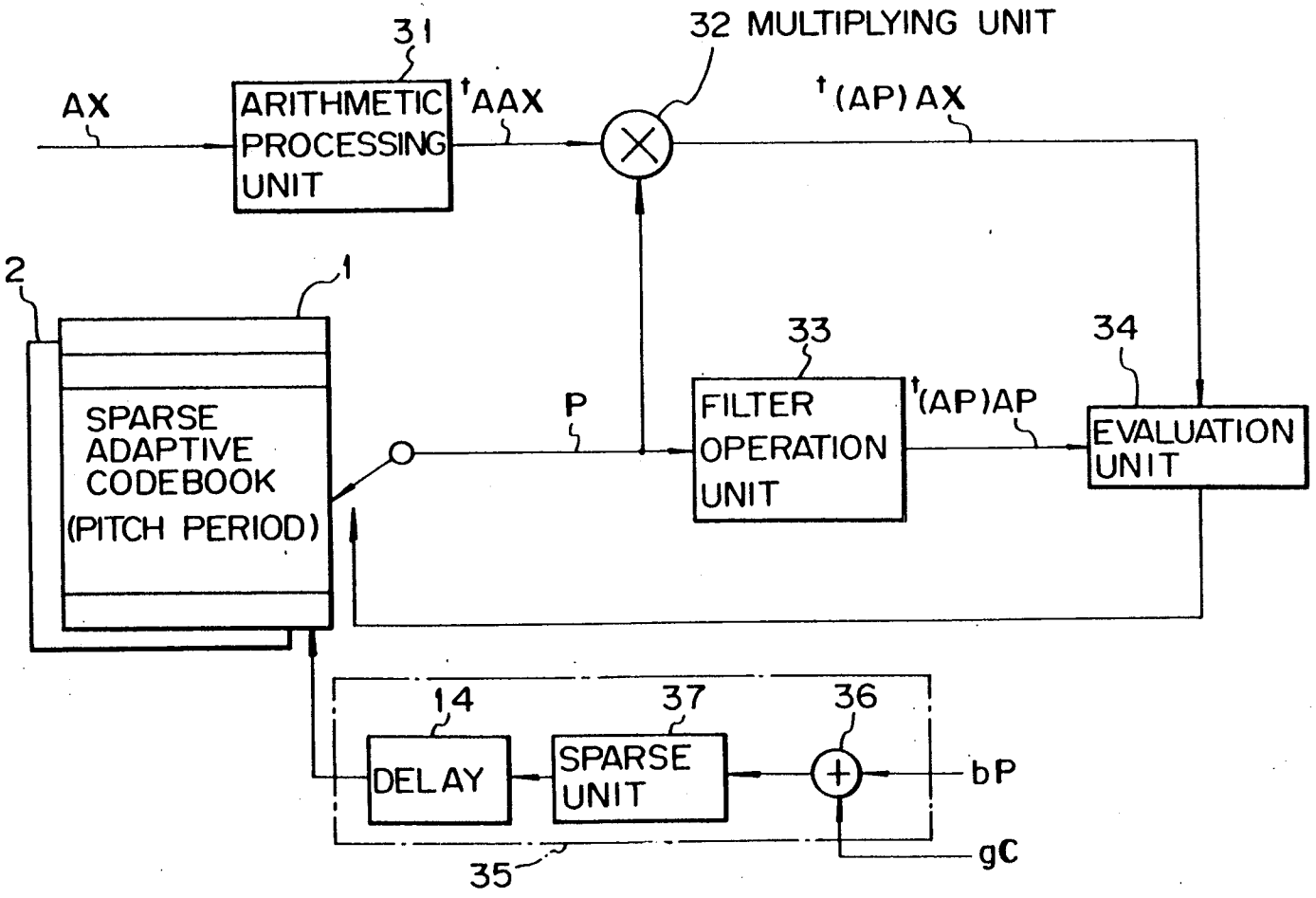
FIG. 5 is a block diagram showing more concretely the structure of FIG. 4.

FIG. 5 is a block diagram showing more concretely the structure of FIG. 4. A fifth means 35 is shown, which fifth means 35 is connected to the sparse adaptive codebook 1, adds the optimum pitch prediction residual vector bP and the optimum code vector gC, performs sparsing or a thinning operation on the results of the addition, and stores the results in the sparse adaptive codebook 1.

The fifth means 35, as shown in the example, includes an adder 36 which adds in time series the optimum pitch prediction residual vector bP and the optimum code vector gC; a sparse unit 37 which receives as input the output of the adder 36; and a delay unit 14 which gives a delay corresponding to one frame to the output of the sparse unit 37 and stores the result in the sparse adaptive codebook 1.

Figure 6:
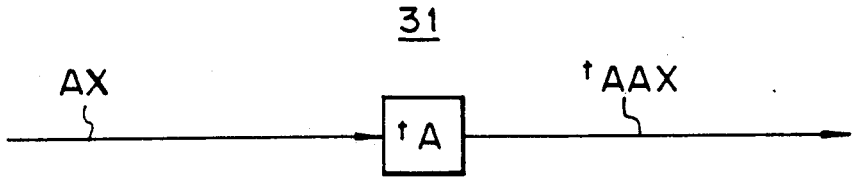
FIG. 6 is a block diagram showing a first example of the arithmetic processing unit 31.

FIG. 6 is a block diagram showing a first example of the arithmetic processing unit 31. The first means 31 (arithmetic processing unit) is composed of a transposition matrix ${}^tA$ obtained by transposing a finite impulse response (FIR) perceptual weighting filter matrix A.

Figure 7:
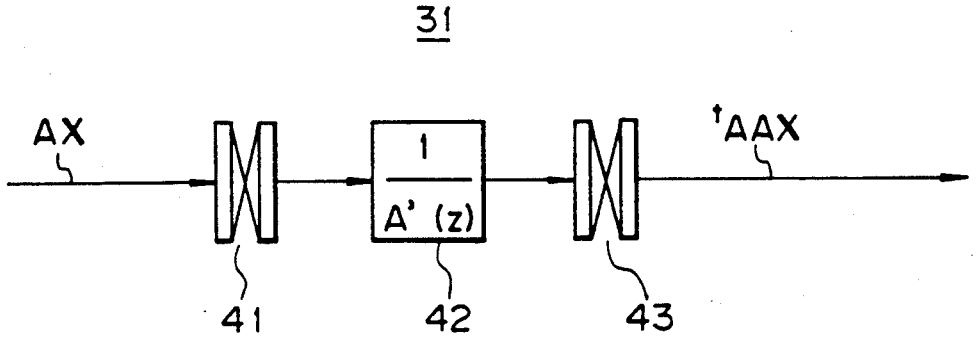
FIG. 7 is a view showing a second example of the arithmetic processing unit 31.

FIG. 7 is a view showing a second example of the arithmetic processing means 31. The first means 31 (arithmetic processing unit) here is composed of a front processing unit 41 which rearranges time reversely or time reverses the input speech signal vector AX along the time axis, an infinite impulse response (IIR) perceptual weighting filter 42, and a rear processing unit 43 which rearranges time reversely the output of the filter 42 once again along the time axis.

FIGS. 8A and 8B and FIG. 8C are views showing the specific process of the arithmetic processing unit 31 of FIG. 6. That is, when the FIR perceptual weighting filter matrix A is expressed by the following:

$$A = \begin{bmatrix} a_1 & - & - & - & 0 & 0 \\ a_2 & a_1 & - & - & - & 0 \\ a_3 & a_2 & a_1 & - & - & -0 \\ a_N & a_{N-1} & - & - & - & a_1 \end{bmatrix}$$

the transposition matrix $^tA$, that is, $$^tA = \begin{bmatrix} a_1 a_2 \ldots & a_N \\ 0\, a_1 \ldots & a_{N-1} \\ \cdot\ \cdot\ \cdot\ \cdot\ \cdot & \cdot \\ 0\ 0 \ldots & a_1 \end{bmatrix}$$

is multiplied with the input speech signal vector, that is, $$AX = \begin{bmatrix} X_1 \\ X_2 \\ \cdot \\ \cdot \\ \cdot \\ X_N \end{bmatrix}$$

The first means 31 (arithmetic processing unit) outputs the following:

$$^tAAX \begin{bmatrix} a_1{}^*X_1 + a_2{}^*X_2 + \ldots + a_N{}^*X_N \\ a_1{}^*X_2 + \ldots + a_{N-1}{}^*X_N \\ \cdot \qquad \ldots \\ \cdot \qquad a_1{}^*X_N \end{bmatrix}$$

(where, the asterisk means multiplication)

FIGS. 9A, 9B, and 9C and FIG. 9D are views showing the specific process of the arithmetic processing unit 31 of FIG. 7. When the input speech signal vector AX is expressed by the following:

$$AX = \begin{bmatrix} X_1 \\ X_2 \\ \cdot \\ \cdot \\ \cdot \\ X_N \end{bmatrix}$$

the front processing unit 41 generates the following:

$$(AX)_{TR} = \begin{bmatrix} X_N \\ \cdot \\ \cdot \\ \cdot \\ X_2 \\ X_1 \end{bmatrix}$$

(where TR means time reverse)

This $(AX)_{TR}$, when passing through the next IIR perceptual weighting filter 42, is converted to the following:

$$A\,(AX)_{TR} = \begin{bmatrix} d_N \\ \cdot \\ \cdot \\ \cdot \\ d_2 \\ d_1 \end{bmatrix}$$

This $A(AX)_{TR}$ is output from the next rear processing unit 43 as W, that is:

$$W = \begin{bmatrix} d_1 \\ d_2 \\ \cdot \\ \cdot \\ \cdot \\ d_N \end{bmatrix} = {}^tAAX$$

In the embodiment of FIGS. 9A to 9D, the filter matrix A was made an IIR filter, but use may also be made of an FIR filter. If an FIR filter is used, however, in the same way as in the embodiment of FIGS. 8A to 8C, the total number of multiplication operations becomes $N^2/2$ (and 2N shifting operations), but in the case of use of an IIR filter, in the case of, for example, a 10th order linear prediction synthesis, only 10N multiplication operations and 2N shifting operations are necessary.

Referring to FIG. 5 once again, an explanation will be made below of three examples of the sparse unit 37 in the figure.

Figure 10:
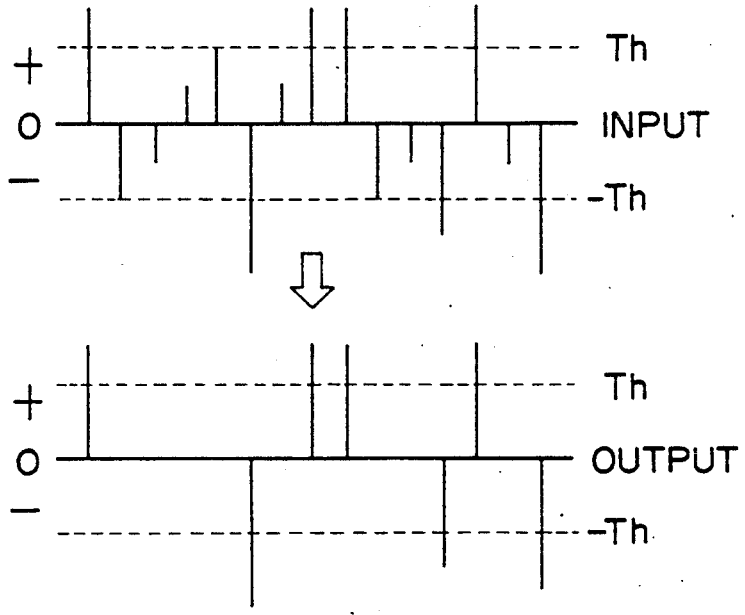
FIG. 10 is a view for explaining the operation of a first example of a sparse unit 37 shown in FIG. 5.

FIG. 10 is a view for explaining the operation of a first example of a sparse unit 37 shown in FIG. 5. As clear from the figure, the sparse unit 37 is operative to selectively supply to the delay unit 14 only outputs of the adder 36 where the absolute value of the level of the outputs exceeds the absolute value of a fixed threshold level Th, transform all other outputs to zero, and exhibit a center clipping characteristic as a whole.

Figure 11:
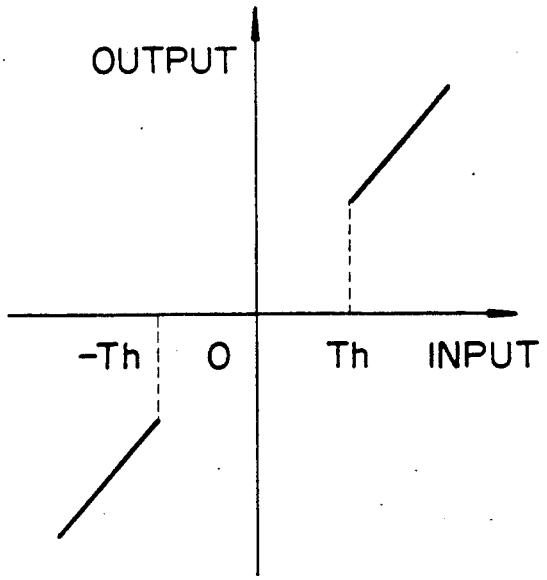
FIG. 11 is a graph showing illustratively the center clipping characteristic.

FIG. 11 is a graph showing illustratively the center clipping characteristic. Inputs of a level smaller than the absolute value of the threshold level are all transformed into zero.

Figure 12:
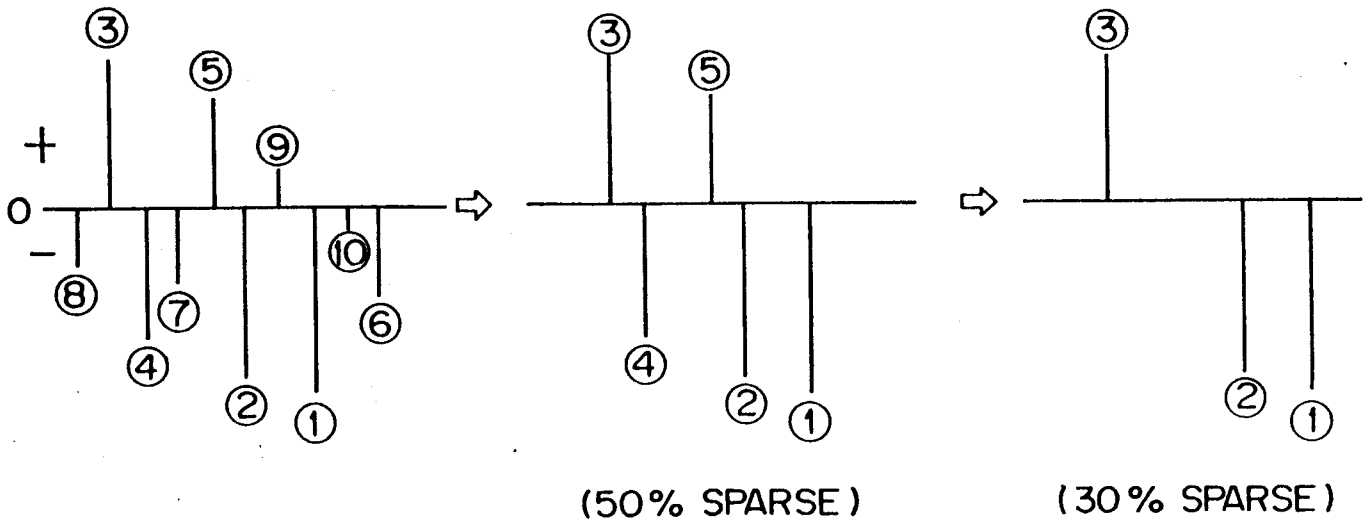
FIG. 12 is a view for explaining the operation of a second example of the sparse unit 37 shown in FIG. 5.

FIG. 12 is a view for explaining the operation of a second example of the sparse unit 37 shown in FIG. 5. The sparse unit 37 of this figure is operative, first of all, to take out or sample the output of the adder 36 at certain intervals corresponding to a plurality of sample points, find or determine the absolute value of the outputs of each of the sample points, then give ranking successively from the outputs with the large absolute values to the ones with the small ones, selectively supply to the delay unit 14 only the outputs corresponding to the plurality of sample points with high ranks, transform all other outputs to zero, and exhibit a center clipping characteristic (FIG. 11) as a whole.

In FIG. 12, a 50 percent sparsing indicates to leave the top 50 percent of the sampling inputs and transform the other sampling inputs to zero. A 30 percent sparsing means to leave the top 30 percent of the sampling input and transform the other sampling inputs to zero. Note that in the figure the circled numerals 1, 2, 3 . . . show the signals with the largest, next largest, and next next largest amplitudes, respectively.

By this, it is possible to accurately control the number of sample points (sparse degree) not zero having a direct effect on the amount of arithmetic operations of the pitch retrieval.

Figure 13:
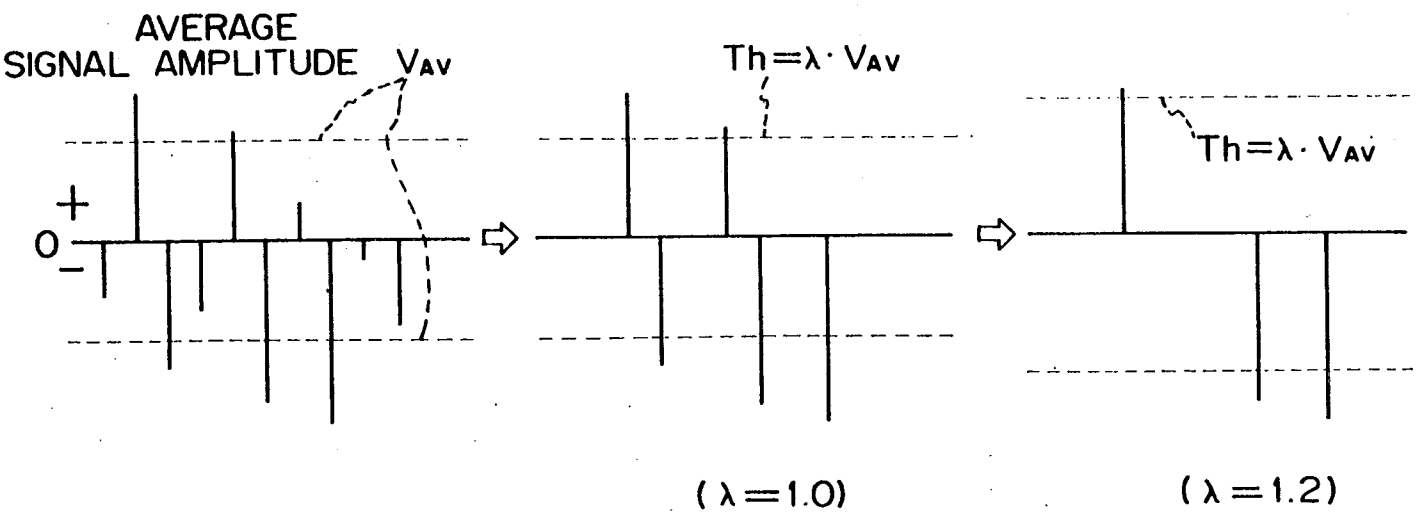
FIG. 13 is a view for explaining the operation of a third example of the sparse unit 37 shown in FIG. 5.

FIG. 13 is a view for explaining the operation of a third example of the sparse unit 37 shown in FIG. 5. The sparse unit 37 is operative to selectively supply to the delay unit 14 only the outputs of the adder 36 where the absolute values of the outputs exceed the absolute value of the given threshold level Th and transform the other outputs to zero. Here, the absolute value of the threshold Th is made to change adaptively to become higher or lower in accordance with the degree of the average signal amplitude $V_{AV}$ obtained by taking the average of the outputs over time and exhibits a center clipping characteristic overall.

That is, the unit calculates the average signal amplitude $V_{AV}$ per sample with respect to the input signal, multiplies the value $V_{AV}$ with a coefficient $\lambda$ to determine the threshold level $Th=V_{AV}\cdot\lambda$, and uses this threshold level Th for the center clipping. In this case, the sparsing degree of the adaptive codebook 1 changes somewhat depending on the properties of the signal, but compared with the embodiment shown in FIG. 11, the amount of arithmetic operations necessary for ranking the sampling points becomes unnecessary, so less arithmetic operations are sufficient.

Figure 14:
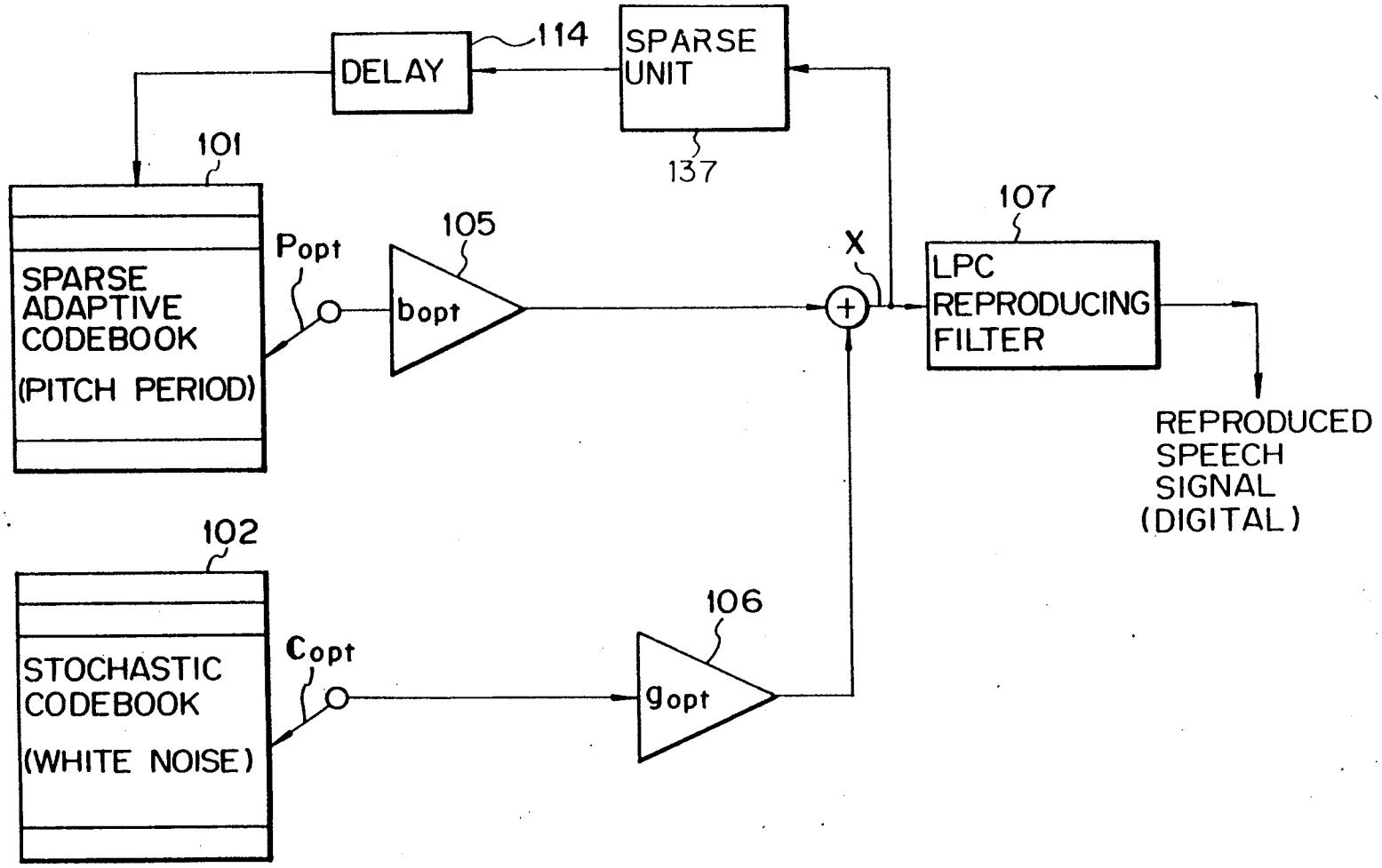
FIG. 14 is a block diagram showing an example of a decoder side in the system according to the present invention.

FIG. 14 is a block diagram showing an example of a decoder side in the system according to the present invention. The decoder receives a coding signal produced by the above-mentioned coder side. The coding signal is composed of a code ($P_{opt}$) showing the optimum pitch prediction residual vector closest to the input speech signal, the code ($C_{opt}$) showing the optimum code vector, and the codes ($b_{opt}$, $g_{opt}$) showing the optimum gains (b, g). The decoder uses these optimum codes to reproduce the input speech signal.

The decoder is comprised of substantially the same constituent elements as the constituent elements of the coding side and has a linear prediction code (LPC) reproducing filter 107 which receives as input a signal corresponding to the sum of the optimum pitch prediction residual vector bP and the optimum code vector gC and produces a reproduced speech signal.

That is, as shown in FIG. 14, the same as the coding side, provision is made of a sparse adaptive codebook 101, stochastic codebook 102, sparse unit 137, and delay unit 114. The optimum pitch prediction residual vector $P_{opt}$ selected from inside the adaptive codebook 101 is multiplied with the optimum gain $b_{opt}$ by the amplifier 105. The resultant optimum code vector $b_{opt}P_{opt}$, in addition to $g_{opt}C_{opt}$, is sparsed by the sparse unit 137. The optimum code vector $C_{opt}$ selected from inside the stochastic codebook 102 is multiplied with the optimum gain $g_{opt}$ by the amplifier 106, and the resultant optimum code vector $g_{opt}C_{opt}$ is added to give the code vector X. This is passed through the linear prediction code reproducing filter 107 to give the reproduced speech signal and is given to the delay unit 114 via sparse unit 137.

We claim:

1. A speech coding and decoding system which includes coder and decoder sides, the coder side including an adaptive codebook for storing a plurality of pitch prediction residual vectors (P) and a stochastic codebook for storing a plurality of code vectors (C) comprises of white noise, whereby use is made of indexes having an optimum pitch prediction residual vector (bP) and optimum code vector (gC) (b and g gains) closest to a perceptually weighted input speech signal vector (AX) to code an input speech signal, and the decoder side reproducing the input speech signal in accordance with the code, wherein the adaptive codebook comprises a sparse adaptive codebook for storing a plurality of sparse pitch prediction residual vectors (P), and wherein the coder side comprises:

first means for receiving the perceptually weighted input speech signal vector and for arithmetically processing a time-reversing perceptual weighted input speech signal ($^t$AAX) from the perceptually weighted input speech signal vector (AX);

second means for receiving as a first input the time-reversing perceptual weighted input speech signal output from the first means, and for receiving as a second input the plurality of sparse pitch prediction residual vectors (P) successively output from the sparse adaptive codebook, and for multiplying the two inputs producing a correlation value ($^t$AP)AX);

third means for receiving the pitch prediction residual vectors and for determining autocorrelation value ($^t$(AP)AP) of a vector (AP) being a perceptual weighting reproduction of the plurality of pitch prediction residual vectors; and fourth means for receiving the correlation value from the second means and the autocorrelation value from the third means, and for determining an optimum pitch prediction residual vector and an optimum code vector.

2. A system as set forth in claim 1, further comprising fifth means, connected to the sparse adaptive codebook, for adding the optimum pitch prediction residual vector and the optimum code vector, and for performing a thinning operation and for storing a result in the sparse adaptive codebook.

3. A system as set forth in claim 2, wherein said fifth means comprises:

an adder which adds in time series the optimum pitch prediction residual vector and the optimum code vector and outputs a first result;

a sparse unit which receives as input the first result output by the adder and outputs a second result; and a delay unit which gives a delay corresponding to one frame to the second result output by the sparse unit and stores the second result delayed by the one frame as the result in the sparse adaptive codebook.

4. A system as set forth in claim 2, wherein said first means is composed of a transposition matrix ($^t$A) obtained by transposing a finite impulse response (FIR) perceptual weighting filter matrix (A).

5. A system as set forth in claim 2, wherein the first means is composed of a front processing unit which time reverses the input speech signal vector (AX) along a time axis, an infinite impulse response (IIR) perceptual weighting filter outputting a filter output, and a rear processing unit which time reverses the filter output of the infinite impulse response (IIR) perceptual weighting filter again along the time axis.

6. A system as set forth in claim 4, wherein when the FIR perceptual weighting filter matrix (A) is expressed by the following:

$$A = \begin{bmatrix} a_1 & - & - & - & 0 & 0 \\ a_2 & a_1 & - & - & - & 0 \\ a_3 & a_2 & a_1 & - & - & -0 \\ a_N & a_{N-1} & - & - & - & a_1 \end{bmatrix}$$

the transposition matrix ($^tA$), that is, $$^tA = \begin{bmatrix} a_1 a_2 \ldots & a_N \\ 0\, a_1 \ldots & a_{N-1} \\ \cdot\ \cdot\ \cdot\ \cdot & \cdot \\ 0\ 0 \ldots & a_1 \end{bmatrix}$$

is multiplied with the input speech signal vector, that is, $$AX = \begin{bmatrix} X1 \\ X2 \\ \cdot \\ \cdot \\ \cdot \\ XN \end{bmatrix}$$

and the first means (31) outputs the following:

$$^tAAX \begin{bmatrix} a_1{}^*X_1 + a_2{}^*X_2 + \ldots + a_N{}^*X_N \\ a_1{}^*X_2 + \ldots + a_{N-1}{}^*X_N \\ \ldots \\ a_1{}^*X_N \end{bmatrix}$$

(where, the asterisk means multiplication).

7. A system as set forth in claim 5, wherein when the input speech signal vector (AX) is expressed by the following:

$$AX = \begin{bmatrix} X1 \\ X2 \\ \cdot \\ \cdot \\ \cdot \\ XN \end{bmatrix}$$

the front processing unit generates the following:

$$(AX)_{TR} = \begin{bmatrix} XN \\ \cdot \\ \cdot \\ \cdot \\ X2 \\ X1 \end{bmatrix}$$

(where TR means time reverse)

and this $(AX)_{TR}$, when passing through the next IR perceptual weighting filter, is converted to the following:

$$A\,(AX)_{TR} = \begin{bmatrix} d_N \\ \cdot \\ \cdot \\ \cdot \\ d_2 \\ d_1 \end{bmatrix}$$

and this $A(AX)_{TR}$ is output from the next rear processing unit as W, that is:

$$W = \begin{bmatrix} d_1 \\ d_2 \\ \cdot \\ \cdot \\ \cdot \\ d_N \end{bmatrix} = {}^tAAX$$

8. A speech coding and decoding system which includes coder and decoder sides, the coder side including an adaptive codebook for storing a plurality of pitch prediction residual vectors (P) and a stochastic codebook for storing a plurality of code vectors (C) comprised of white noise, whereby use is made of indexes having an optimum pitch prediction residual vector (bP) and optimum code vector (gC) (b and g gains) closest to a perceptually weighted input speech signal vector (AX) to code an input speech signal, and the decoder side reproducing the input speech signal in accordance with the code, wherein the adaptive codebook comprises a sparse adaptive codebook for storing a plurality of sparse pitch prediction residual vectors (P), and wherein the coder side comprises:

first means for receiving the perceptually weighted input speech signal vector and for arithmetically processing a time-reversing perceptual weighted input speech signal ($^tAAX$) from the perceptually weighted input speech signal vector (AX);

second means for receiving as a first input the time-reversing perceptual weighted input speech signal output from the first means, and for receiving as a second input the plurality of sparse pitch prediction residual vectors (P) successively output from the sparse adaptive codebook, and for multiplying the two inputs producing a correlation value ($^t$(AP)AX);

third means for receiving the pitch prediction residual vectors and for determining an autocorrelation value ($^t$(AP)AP) of a vector (AP) being a perceptual weighting reproduction of the plurality of pitch prediction residual vectors;

fourth means for receiving the correlation value from the second means and the autocorrelation value from the third means, and for determining an optimum pitch prediction residual vector and an optimum code vector; and fifth means, connected to the sparse adaptive codebook, for adding the optimum pitch prediction residual vector and the optimum code vector, and for performing a thinning operation and for storing a result in the sparse adaptive codebook, wherein the sparse unit selectively supplies to the delay unit only the first result having a first absolute value exceeding a second absolute value of a fixed threshold level, transforms all other of the first result to zero, and exhibits a center clipping characteristic, wherein said fifth means comprises:

an adder which adds in time series the optimum pitch prediction residual vector and the optimum code vector and outputs a first result;

a sparse unit which receives as input the first result output by the adder and outputs a second result; and a delay unit which gives a delay corresponding to one frame to the second result output by the sparse unit and stores the second result delayed by the one frame as the result in the sparse adaptive codebook, wherein the sparse unit selectively supplies to the delay unit only the first result having a first absolute value exceeding a second absolute value of a fixed threshold level, transforms all other of the first result to zero, and exhibits a center clipping characteristic.

9. A speech coding and decoding system which includes coder and decoder sides, the coder side including an adaptive codebook for storing a plurality of pitch prediction residual vectors (P) and a stochastic codebook for storing a plurality of code vectors (C) comprises of white noise, whereby use is made of indexes having an optimum pitch prediction residual vector (bP) and optimum code vector (gC) (b and g gains) closest to a perceptually weighted input speech signal vector (AX) to code an input speech signal, and the decoder side reproducing the input speech signal in accordance with the code, wherein the adaptive codebook comprises a sparse adaptive codebook for storing a plurality of sparse pitch prediction residual vectors (P), and wherein the coder side comprises:

first means for receiving the perceptually weighted input speech signal vector and for arithmetically processing a time-reversing perceptual weighted input speech signal ($^t$AAX) from the perceptually weighted input speech signal vector (AX);

second means for receiving as a first input the time-reversing perceptual weighted input speech signal output from the first means, and for receiving as a second input the plurality of sparse pitch prediction residual vectors (P) successively output from the sparse adaptive codebook, and for multiplying the two inputs producing a correlation value ($^t$(AP)AX);

third means for receiving the pitch prediction residual vectors and for determining an autocorrelation value ($^t$(AP)AP) of a vector (AP) being a perceptual weighting reproduction of the plurality of pitch prediction residual vectors;

fourth means for receiving the correlation value from the second means and the autocorrelation value from the third means, and for determining an optimum pitch prediction residual vector and an optimum code vector; and fifth means, connected to the sparse adaptive codebook, for adding the optimum pitch prediction residual vector and the optimum code vector, and for performing a thinning operation and for storing a result in the sparse adaptive codebook, wherein the sparse unit selectively supplies to the delay unit only the first result having a first absolute value exceeding a second absolute value of a fixed threshold level, transforms all other of the first result to zero, and exhibits a center clipping characteristic, wherein said fifth means comprises:

an adder which adds in time series the optimum pitch prediction residual vector and the optimum code vector and outputs a first result;

a sparse unit which receives an input the first result output by the adder and outputs a second result; and a delay unit which gives a delay corresponding to one frame to the second result output by the sparse unit and stores the second result delayed by the one frame as the result in the sparse adaptive codebook, wherein the sparse unit samples the first result forming a sampled first result of the adder at certain intervals corresponding to a plurality of sample points, determines large and small absolute values of the sampled first result, successively ranks the large absolute values as a high ranking and the small absolute values as a low ranking, selectively supplies to the delay unit only the sampled first result corresponding to the plurality of sample outputs with the high ranking, transforms all other of the sampled first result to zero, and exhibits a center clipping characteristic.

10. A speech coding and decoding system which includes coder and decoder sides, the coder side including an adaptive codebook for storing a plurality of pitch prediction residual vectors (P) and a stochastic codebook for storing a plurality of code vectors (C) comprised of white noise, whereby use is made of indexes having an optimum pitch prediction residual vector (bP) and optimum code vector (gC) (b and g gains) closest to a perceptually weighted input speech signal vector (AX) to code an input speech signal, and the decoder side reproducing the input speech signal in accordance with the code, wherein the adaptive codebook comprises a sparse adaptive codebook for storing a plurality of sparse pitch prediction residual vectors (P), and wherein the coder side comprises:

first means for receiving the perceptually weighted input speech signal vector and for arithmetically processing a time-reversing perceptual weighted input speech signal ($^t$AAX) from the perceptually weighted input speech signal vector (AX);

second means for receiving as a first input the time-reversing perceptual weighted input speech signal output from the first means, and for receiving as a second input the plurality of sparse pitch prediction residual vectors (P) successively output from the sparse adaptive codebook, and for multiplying the two inputs producing a correlation value ($^t$(AP)AX);

third means for receiving the pitch prediction residual vectors and for determining an autocorrelation value ($^t$(AP)AP) of a vector (AP) being a perceptual weighting reproduction of the plurality of pitch prediction residual vectors;

fourth means for receiving the correlation value from the second means and the autocorrelation value from the third means, and for determining an optimum pitch prediction residual vector and an optimum code vector; and fifth means, connected to the sparse adaptive codebook, for adding the optimum pitch prediction residual vector and the optimum code vector, and for performing a thinning operation and for storing a result in the sparse adaptive codebook, whereby the sparse unit selectively supplies to the delay unit only the first result having a first absolute value exceeding a second absolute value of a fixed threshold level, transforms all other of the first result to zero, and exhibits a center clipping characteristic, wherein said fifth means comprises:

an adder which adds in time series the optimum pitch prediction residual vector and the optimum code vector and outputs a first result;

a sparse unit which receives as input the first result output by the adder and outputs a second result; and a delay unit which gives a delay corresponding to one frame to the second result output by the sparse unit and stores the second result delayed by the one frame as the result in the sparse adaptive codebook, wherein the sparse unit selectively supplies to the delay unit only the first result having a first absolute value exceeding a second absolute value of a threshold level, transforms other of the first result to zero, where the second absolute value of the threshold level is made to change adaptively to become higher or lower in accordance with a degree of an average signal amplitude obtained by taking an average of the sampled first result over time, and exhibits a center clipping characteristic.

11. A system as set forth in claim 2, wherein the decoder side receives the code transmitted from the coding side and reproduces the input speech signal in accordance with the code, and wherein the decoder side comprises: generating means for generating a signal corresponding to a sum of the optimum pitch prediction residual vector and the optimum code vector, said generating means substantially comprising the coder side; and a linear prediction code (LPC) reproducing filter which receives as input the signal corresponding to the sum of the optimum pitch prediction residual vector (bP) and the optimum code vector (gC) from said generating means, and produces a reproduced speech signal using the signal.

* * * * *

UNITED STATES PATENT AND TRADEMARK OFFICE

CERTIFICATE OF CORRECTION

PATENT NO. : 5,199,076

DATED : March 30, 1993

INVENTOR(S) : Tomohiko TANIGUCHI et al.

It is certified that error appears in the above-identified patent and that said Letters Patent is hereby corrected as shown below:

Column 2, lines 60 and 67, change "la" to --1a--.

Column 4, lines 17 and 19, change "la" to --1a--.

Column 9, lines 65 and 66, change "comprises" to --comprised--.

Column 10, line 21, change "($^t$AP)AX)" to --($^t$(AP)AX)--.

Column 11, line 65, change "IR" to --IIR--.

Column 13, lines 26 and 27, change "comprises" to --comprised--.

Column 14, line 26, change "outputs" to --points--.

Signed and Sealed this

Twenty-fifth Day of January, 1994

*Attest:*

*Attesting Officer*

BRUCE LEHMAN

*Commissioner of Patents and Trademarks*